US011641935B2

(12) United States Patent
Williams

(10) Patent No.: US 11,641,935 B2
(45) Date of Patent: May 9, 2023

(54) ATTACHABLE TABLE APPARATUS

(71) Applicant: Donald S. Williams, Chicago, IL (US)

(72) Inventor: Donald S. Williams, Chicago, IL (US)

( * ) Notice: Subject to any disclaimer, the term of this patent is extended or adjusted under 35 U.S.C. 154(b) by 0 days.

(21) Appl. No.: 17/673,185

(22) Filed: Feb. 16, 2022

(65) Prior Publication Data

US 2022/0257002 A1 Aug. 18, 2022

Related U.S. Application Data

(60) Provisional application No. 63/150,628, filed on Feb. 18, 2021.

(51) Int. Cl.

| | |
|---|---|
| ***A47B 5/04*** | (2006.01) |
| ***A47B 13/08*** | (2006.01) |
| ***A47B 97/00*** | (2006.01) |
| ***A47B 5/06*** | (2006.01) |
| ***G09F 23/00*** | (2006.01) |

(52) U.S. Cl.

CPC ..... *A47B 5/04* (2013.01); *A47B 5/06* (2013.01); *A47B 13/08* (2013.01); *A47B 13/088* (2013.01); *A47B 97/00* (2013.01); *G09F 23/00* (2013.01); *A47B 2200/0001* (2013.01); *A47B 2200/002* (2013.01); *A47B 2200/0081* (2013.01); *A47B 2220/0075* (2013.01); *A47B 2220/0091* (2013.01)

(58) Field of Classification Search

None

See application file for complete search history.

(56) References Cited

U.S. PATENT DOCUMENTS

| | | | | |
|---|---|---|---|---|
| 2,889,184 | A * | 6/1959 | Golff | A47B 13/08 108/156 |
| 4,227,467 | A | 10/1980 | Kindsfather | |
| D290,919 | S | 7/1987 | Beute | |
| 5,114,038 | A | 5/1992 | Laumann | |
| 5,170,719 | A * | 12/1992 | Pestone | A47B 5/04 211/104 |
| 5,437,493 | A | 8/1995 | Weisleder | |
| D395,797 | S | 7/1998 | Sirlin | |
| 6,732,990 | B2 | 5/2004 | Hudson | |
| 7,000,799 | B1 | 2/2006 | Hamre | |
| 7,232,055 | B1 | 6/2007 | Lim | |
| 7,542,910 | B2 | 6/2009 | Kellough | |
| 7,559,430 | B2 | 7/2009 | D'Olinnpio | |
| 7,565,997 | B1 | 7/2009 | Lim | |
| D601,853 | S | 10/2009 | Tzilvelis | |

(Continued)

*Primary Examiner* — Daniel J Rohrhoff

(74) *Attorney, Agent, or Firm* — Lesavich High-Tech Law Group, S.C.; Stephen Lesavich

(57) ABSTRACT

Attachable Table Apparatus. The attachable table apparatus provides a foldable, movable, removable, serving table, work station, desk, work bench, etc. for the home or work environment or at away from home events such as sporting events and commercial applications such as restaurants, bars, catered events, promotional events, workshops, garages, etc. The attachable table apparatus includes a universal mounting bracket, attachable to deck rails, wall studs, handrails, walls, etc. in a horizontal or vertical mounting orientation, on car or truck tailgates or bumpers, in boats, inside housing, garages, workshops, etc. The attachable table apparatus is folding/collapsible for easy transport and space saving when not in use.

20 Claims, 14 Drawing Sheets

(56) References Cited

U.S. PATENT DOCUMENTS

| | | | | |
|---|---|---|---|---|
| 7,604,027 | B2 * | 10/2009 | Thatcher | B25H 1/04 144/287 |
| 8,024,908 | B2 | 9/2011 | Williams | |
| 8,322,105 | B2 | 12/2012 | Williams | |
| 8,331,877 | B1 | 12/2012 | Wilkinson | |
| 8,463,765 | B2 | 6/2013 | Lesavich | |
| 8,505,768 | B2 | 8/2013 | Bardwell | |
| 8,904,943 | B2 | 12/2014 | Jin | |
| 9,013,301 | B2 | 4/2015 | Williams | |
| 9,037,654 | B2 | 5/2015 | Lesavich et al. | |
| 9,137,250 | B2 | 9/2015 | Lesavich et al. | |
| 9,287,722 | B2 | 3/2016 | Williams | |
| 9,361,479 | B2 | 6/2016 | Lesavich et al. | |
| 9,380,863 | B2 | 7/2016 | Sakanoue | |
| 9,504,314 | B2 | 11/2016 | Leng | |
| 9,569,771 | B2 | 2/2017 | Lesavich et al. | |
| 9,795,236 | B2 | 10/2017 | Smallman | |
| 10,426,282 | B1 | 10/2019 | Hamilton | |
| 11,382,421 | B1 * | 7/2022 | Wolak | A47B 23/02 |
| 2004/0084463 | A1 | 5/2004 | Belasalma | |
| 2007/0164579 | A1 | 7/2007 | Pike | |
| 2007/0266670 | A1 | 11/2007 | Williams | |
| 2010/0064630 | A1 | 3/2010 | Williams | |
| 2011/0000404 | A1 * | 1/2011 | Lauther | A47B 5/06 62/457.7 |
| 2011/0208710 | A1 | 8/2011 | Lesavich | |
| 2012/0097574 | A1 | 4/2012 | Parsons | |
| 2012/0278622 | A1 | 11/2012 | Lesavich et al. | |
| 2013/0000525 | A1 * | 1/2013 | Hall | A47B 5/06 108/36 |
| 2013/0057005 | A1 | 3/2013 | Grieve | |
| 2013/0125795 | A1 * | 5/2013 | Burke | A63H 19/36 29/428 |
| 2014/0000322 | A1 | 1/2014 | Williams | |
| 2014/0037910 | A1 * | 2/2014 | Leng | A47B 13/08 428/172 |
| 2014/0189792 | A1 | 7/2014 | Lesavich et al. | |
| 2015/0205558 | A1 | 1/2015 | Williams | |
| 2015/0379301 | A1 | 12/2015 | Lesavich et al. | |
| 2016/0066727 | A1 | 3/2016 | Koufos | |
| 2016/0121772 | A1 | 5/2016 | Stecko | |
| 2016/0321654 | A1 | 11/2016 | Lesavich et al. | |
| 2016/0353878 | A1 * | 12/2016 | Nelson | A47B 5/04 |
| 2017/0086603 | A1 | 3/2017 | Sortino | |
| 2017/0188697 | A1 | 7/2017 | Lin | |
| 2017/0224143 | A1 | 8/2017 | Daley | |
| 2017/0251807 | A1 | 9/2017 | Haskins | |
| 2017/0265632 | A1 | 9/2017 | Johnson | |
| 2017/0311714 | A1 * | 11/2017 | Demasi, III | A47B 97/00 |
| 2018/0127151 | A1 | 5/2018 | Pantelleria | |
| 2019/0084462 | A1 * | 3/2019 | Howe | A47B 37/04 |
| 2021/0237254 | A1 * | 8/2021 | Reynolds | B25H 5/00 |
| 2022/0369802 | A1 * | 11/2022 | Springer | F16M 11/041 |

* cited by examiner

ATTACHABLE TABLE APPARATUS

CROSS REFERENCES TO RELATED APPLICATIONS

The Utility patent application claims priority to U.S. Provisional patent application No. 63/150,628, filed Feb. 18, 2021, the contents of which are incorporated by reference.

FIELD OF INVENTION

This application relates to foldable and attachable tables. More specifically, it relates to an attachable table apparatus.

BACKGROUND OF THE INVENTION

There are many types of foldable tables. Such foldable tables are used indoors in kitchens, dinning rooms, garages, etc. The foldable tables are also used outdoors on decks, patios, in backyards, driveways, etc.

There are several problems associated with such foldable tables. One problem is that foldable tables are heavy and have to be moved into place folded and unfolded to use.

Another problem is that such tables cannot be mounted or permanently attached to a surface or a structure.

Another problem is that such tables do not allow social distancing between users of the table.

Another problems is that such tables do not allow a table top surface to be switched from a material used indoors to a material suitable for outdoor use.

Another problem is that such tables do not provide Universal Serial Bus (USB) ports to charge mobile devices such as smart phones or electronic tablets.

Another problem is that such tables do not provide power strips for connecting electrical devices.

Another problem is that such tables do not include larger surfaces for using as a work bench that can support heavier projects in a workshop, factory, etc.

Thus, it is desirable to solve some of the problems associated with foldable tables.

SUMMARY OF THE INVENTION

In accordance with preferred embodiments of the present invention, some of the problems associated with foldable tables are overcome. A foldable table apparatus is presented.

The attachable table apparatus provides a serving table, work station, desk, work bench, etc. for the home or work environment or at away from home events such as sporting events and commercial applications such as restaurants, bars, catered events, promotional events, etc. The attachable table apparatus includes a universal mounting bracket, attachable to deck rails, wall studs, handrails, walls, etc. in a horizontal or vertical mounting orientation, on car or truck tailgates or bumpers, in boats, inside housing, garages, workshops, etc. The attachable table apparatus is folding/collapsible for easy transport and space saving when not in use.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF PREFERRED EMBODIMENTS

Exemplary Folding Table Apparatus

Figure 1A:
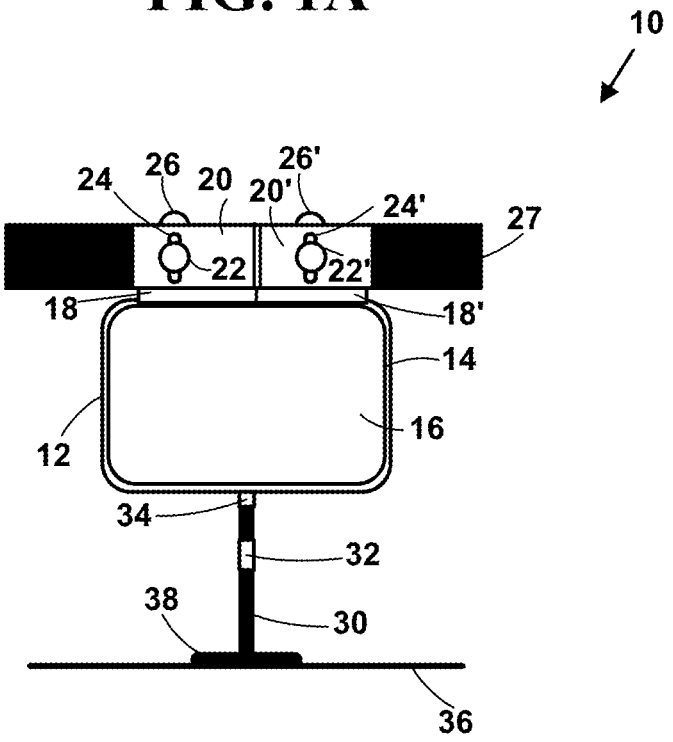
FIG. 1A is a block diagram illustrating a top view of a folding table apparatus.

FIG. 1A is a block diagram 10 illustrating a top view of a folding table apparatus 12.

Figure 1B:
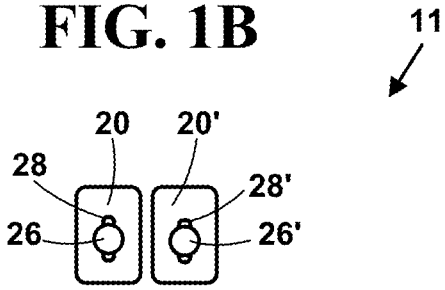
FIG. 1B is a block diagram illustrating a top view of a folding table apparatus connection component.

FIG. 1B is a block diagram 11 illustrating a top view of a folding table apparatus 12 connection component 20.

Figure 7:
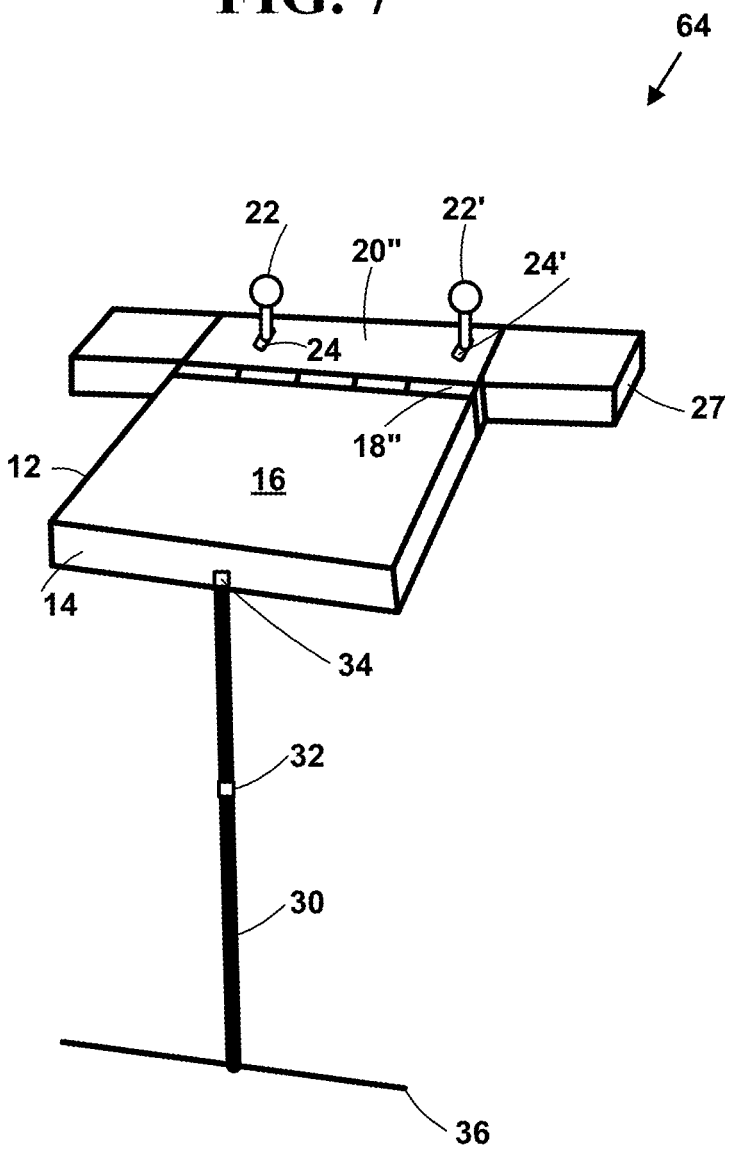
FIG. 7 is a block diagram illustrating a perspective view of the folding table apparatus in an open, unfolded configuration.
Figure 8:
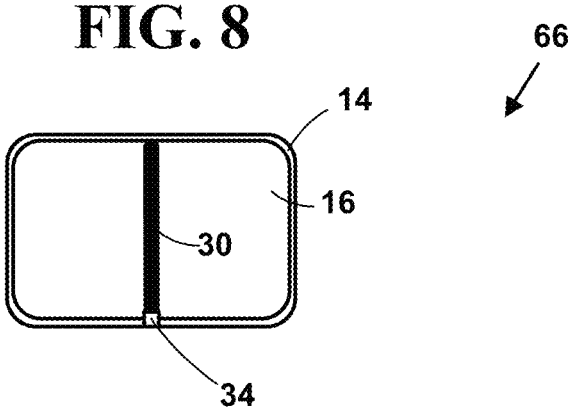
FIG. 8 is a block diagram illustrating a bottom view of the folding table apparatus.

In FIG. 1A, the folding table apparatus 12, includes, but is not limited to, a frame component 14 including a table top component 16. The table top component 16 is insertable and removable from the frame component 14. One or more hinged components 18,18' (only two of which are illustrated for simplicity) connected at a first end to the frame component 14 and at a second end to one or more fastening components 20, 20' (only two of which are illustrated for simplicity) to change the folding table apparatus 12 from a closed, folded configuration 80 (illustrated in FIG. 10) to an open, un-folded configuration 82 (illustrated in FIG. 11), In FIG. 1A, the one or more fastening components 20, 20' each comprising: a fastening component with a horizontal adjustment component 22, 22' with a horizontal adjustment receptacle containment component 24, 24' and a vertical adjustment component 26, 26', with a vertical adjustment receptacle containment component 28, 28' (FIG. 1B). In FIG. 1A, the one or more fastening components 20, 20' are connected at a first end to the one or more hinged components 18, 18' (only two of which are illustrated for simplicity) and at a second end to a vertical or horizontal structural component 27 (only a horizontal structural component 27 is illustrated for simplicity) for securing the folding table apparatus 12 to the vertical or horizontal structural component 27. One or more adjustable folding leg components 30 (only one of which is illustrated for simplicity), including a leg adjusting component 32 for allowing an individual adjustable folding leg component from the one or more adjustable leg components 30 to be adjusted to plural different vertical lengths, a first end of the individual adjustable folding leg component 30 attached to the frame component 14 with a leg hinge component 34 for supporting the folding table apparatus 12 in an open, un-folded configuration, the first end of the individual adjustable folding leg component 30 including the leg hinge component 34 for folding the individual adjustable folding leg component to and from an open, un-folded configuration (FIG. 7) and a closed, folded configuration (FIG. 8). The individual adjustable folding leg component 30 in the closed, folded confirmation is configured to a pre-determined length with the leg adjusting component 32 to fit within an inner boundary of the frame component 14 and against a bottom surface of the table top component 16. In FIG. 8, a second end of the individual adjustable folding leg component 30 supports the folding table apparatus 12 on a horizontal surface 36 in an open, un-folded configuration. The second end of the individual adjustable folding leg component 30 may further include, but is not limited to, an additional horizontal stabilizing component 38. However, the present invention is not limited to such an embodiment and more, fewer and/or other components can be used to practice the invention.

Figure 2:
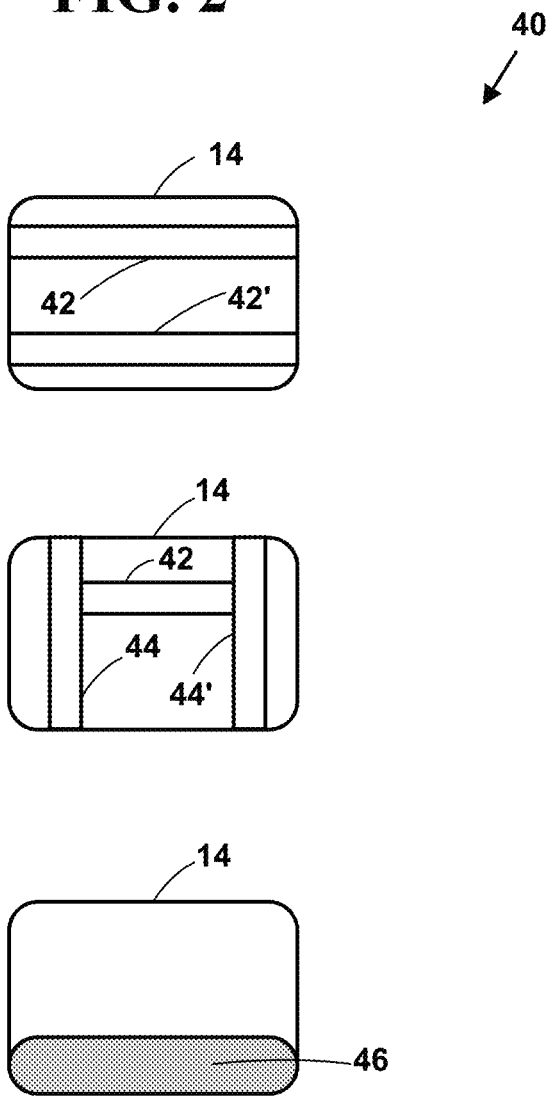
FIG. 2 is a block diagram illustrating various embodiments of the frame component of the folding table apparatus.

FIG. 2 is a block diagram 40 illustrating various embodiments of the frame component 14 of the folding table apparatus 12.

Figure 3:
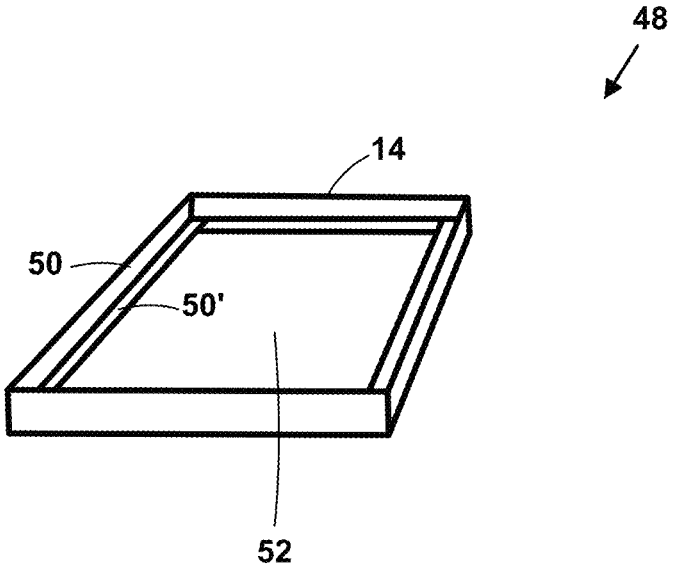
FIG. 3 is a block diagram illustrating a perspective view of the frame component of the folding table apparatus.

FIG. 3 is a block diagram 48 illustrating a perspective view of the of the frame component of the folding table apparatus 14 including a frame edge component 50 and a frame entire surface area component 52.

The frame component 14 comprises metal (e.g., steel, stainless steel, iron, brass, aluminum, etc.), wood, rubber, plastic, composite materials and/or combinations thereof. However the present invention is not limited to such embodiments, and other materials can be used to practice or produce the invention.

The frame component 14 includes, but is not limited to, one or more frame support components. The frame support components (only two of which are illustrated for simplicity), may be oriented in a horizontal direction 42, 42' a vertical direction 44, 44' and/or a combination of horizontal 42, 42' and vertical 44, 44' frame support components, with a pre-determined spacing between the components, and/or a solid component 46 (only one of which is illustrated for simplicity) that includes a support component including about 1% to 100% of the surface area of the frame component 14. At 1% the frame support component includes only a frame edge component 50 (FIG. 3). At 100% coverage, the frame support component comprises an entire surface area component 52 (FIG. 3) of the frame component 14. However the present invention is not limited to such embodiments, and other embodiments and more, fewer and other types of frame support components may be used to practice the invention.

The frame support components 42, 42', 44, 44', 46 comprises metal (e.g., steel, stainless steel, iron, brass, aluminum, etc.), wood, rubber, plastic, composite materials and/or combinations thereof. However the present invention is not limited to such embodiments, and other materials can be used to practice or produce the invention.

In FIG. 3, the frame component 14 further includes an edge component 50 of a pre-determined height and width (e.g., from about 1 inch (2.54 centimeters) to about 4 inches (10.16 cm) etc.) and a lip or shelf support component 50' of a pre-determined width (e.g., from about 1 inch (2.54 cm) to about 4 inches (10.16 cm) etc.) to support the table top component 16 directly and/or to support the horizontal frame support components 42, 42', the vertical frame support components 44, 44' and/or the solid component 46. However the present invention is not limited to such embodiments, and other embodiments with other measurements and/or other material materials may be used to practice the invention.

In one embodiment, the frame component 14 and the table top component 16 are blow molded, thermos formed, rotationally and/or injection molded as one single unit. However the present invention is not limited to such an embodiment and other embodiments can be used to practice the invention.

The frame edge component 50 further includes a frame lip or shelf support component 50' that comprises metal (e.g., steel, stainless steel, iron, brass, aluminum, etc.), wood, rubber, plastic, composite materials and/or combinations thereof. However the present invention is not limited to such embodiments, and other materials can be used to practice or produce the invention.

Figure 4:
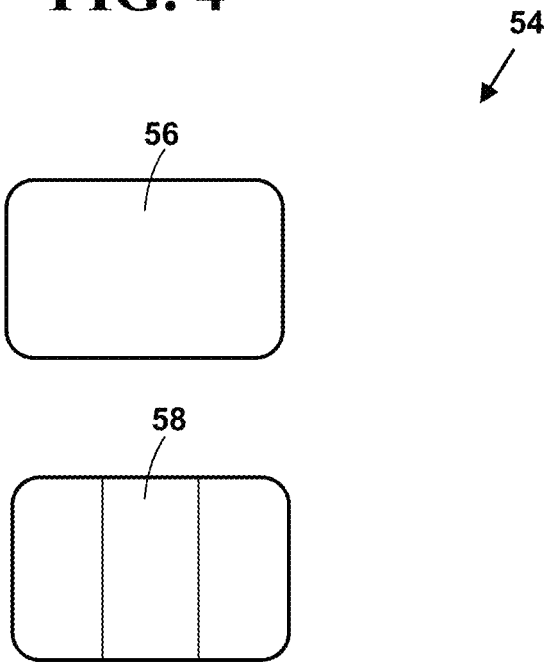
FIG. 4 is a block diagram illustrating various embodiments of the table top component.

FIG. 4 is a block diagram 54 illustrating various embodiments of the table top component 16.

In one embodiment, the table top component 16 includes a one-piece solid component 56. In another embodiment, the table top component includes a plural piece solid component 58 (only three of which are illustrated for simplicity). In a plural piece solid component 56 embodiment, the edges of the individual pieces are beveled (i.e., cut at a desired angle of less than 90 degrees) to capture and aid in drainage of liquid materials that may spelled on the table top component. In another embodiment, the edges of the individual pieces are not beveled. However the present invention is not limited to such embodiments, and other embodiments can be used to practice the invention.

The table top component 16, 56, 58, comprises metal (e.g., steel, stainless steel, iron, brass, aluminum, etc.), wood, rubber, plastic, composite materials and/or combinations thereof. However the present invention is not limited to such embodiments, and other materials can be used to practice or produce the invention.

In one embodiment, the table top component 16, 56, 58 is dynamically insertable and removable from the frame component 14. In such an embodiment, a first table top component 16, 56, 58 comprises a first material (e.g., wood, etc.) can be removed and a second table top component 16', 56', 58' comprises a second material (e.g., metal, plastic etc.) can be dynamically inserted into the frame component 14, for example when the folding table apparatus 12 is moved from use in an indoor setting to an outdoor setting. However the present invention is not limited to such embodiments, and other materials can be used to practice the invention In one embodiment, the table top component 16, 56, 58 is removable and insertable and includes advertising elements (e.g., for businesses, institutions, charities, goods, services, restaurant/bar names, corporate promotional branding, etc.) names of sports teams, etc. However the present invention is not limited to such embodiments, and other embodiments can be used to practice the invention.

In another embodiment, the plural piece table top component 58 each include plural different advertising elements, sports team names, etc. However the present invention is not limited to such embodiments, and other embodiments can be used to practice the invention.

In another embodiment, the table top component 16, 56, 58 is integral to the frame component 14 and inserted during a manufacturing process. In such an embodiment, the table top component 16, 56, 58 is not removable. However the present invention is not limited to such embodiments, and other materials can be used to practice the invention.

The first hinged component 18 changes the orientation of the folding table apparatus 12 from a horizontal orientation (i.e., unfolded) in an open position, to a vertical orientation (i.e., folded) in a closed position In one embodiment, the first hinged component 18 includes a single hinged component 18" (FIG. 7) including but not limited to, a piano hinge, continuous hinge, foldable self-locking hinge, etc. In another embodiment the first hinged component includes plural separate hinged components 18, 18' (FIG. 1) However the present invention is not limited to such embodiments, and other embodiments can be used to practice the invention.

The first hinged component 18, 18', 18" comprises metal (e.g., steel, stainless steel, iron, brass, aluminum, etc.), wood, rubber, plastic, composite materials and/or combinations thereof. However the present invention is not limited to such embodiments, and other materials can be used to practice or produce the invention.

Figure 5:
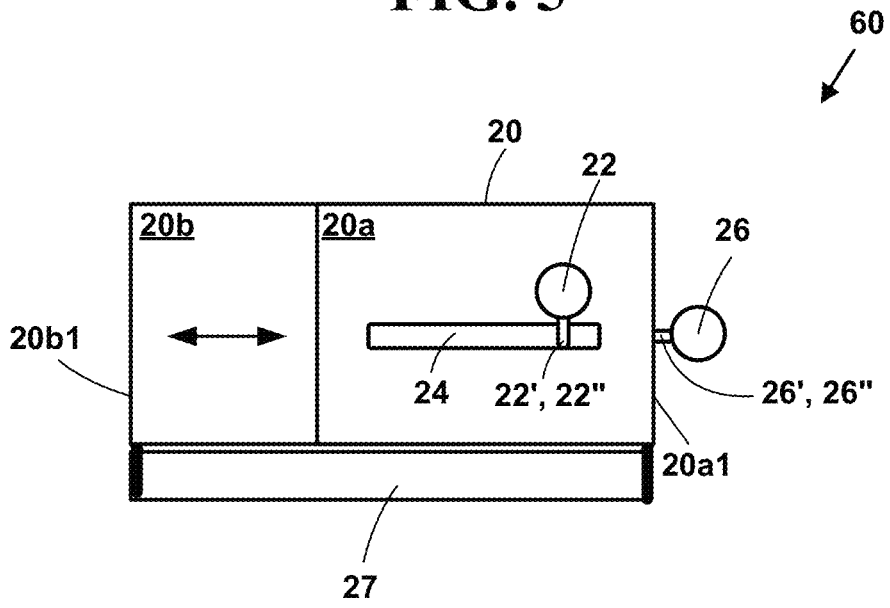
FIG. 5 is a block diagram illustrating the first fastening component.

FIG. 5 is a block diagram 60 illustrating additional details of the first fastening component 20.

The first fastening component 20 includes a first top portion 20*a* with a first gripping end 20*a*1 and a second bottom portion 20*b* that slides beneath the top portion 20*a* with a second gripping end 20*b*1. The first gripping end 20*a*1 and second gripping end 20*b*1 grasp a horizontal structural component 27 (e.g., deck rail, etc.) to attach the folding table apparatus 12 to the horizontal structural component 27.

The first horizontal adjustment component 22 with the first horizontal adjustment receptacle containment component 24 is used to adjust the fastening component 20 to a desired width to grip horizontal connection components of various sizes. The first horizontal adjustment component 22 moves forward and backward in the horizontal adjustment receptacle containment component 24 to adjust an attachment size for the first horizontal adjustment component 22 to the horizontal structural component 27. In another embodiment, the first horizontal adjustment component 22 includes a non-adjustable first horizontal adjustment receptacle containment component 24. In such an embodiment, the first horizontal adjustment receptacle containment component 24 is specifically sized and shaped to include a size and shape just slightly larger (e.g., about 1/16 inches or about 1.57 millimeters (mm), larger etc.) to contain a shaft for the first horizontal adjustment component 24. However, the present invention is not limited to such an embodiment and other embodiments can be used to practice the invention.

In one embodiment, the first horizontal adjustment component 22 includes a threaded shaft 22' that is rotated to tighten and loosen the first horizontal adjustment component 22. When the first horizontal adjustment component 22 is loosened, the second bottom portion 20*b* can then slide out beneath the top portion 20*b* adjusting the second gripping end 20*b*1 outward to a second edge of the horizontal structural component 27. The first gripping end 20*a*1 grips a horizontal edge of horizontal structural component 27 (e.g., deck rail, etc.). The first horizontal adjustment component 22 includes with the threaded shaft 22' is then rotated to tighten the first horizontal adjustment component 22 in place on the horizontal component. However the present invention is not limited to such embodiments, and other embodiments can be used to practice the invention.

In another embodiment, the first horizontal adjustment component 22 includes a shaft 22' with a spring component 22". To loosen the first horizontal adjustment component 22, the first horizontal adjustment component 22 is pulled up to compress the spring component 22". The second bottom portion 20*b* can then slide out beneath the top portion 20*b* adjusting the second gripping end 20*b*1 outward to a second edge of the horizontal structural component 27. The first gripping end 20*a*1 grips a first edge of the horizontal structural component 27 (e.g., deck rail, etc.). When the first horizontal adjustment component 22 is released, the spring component 22" is uncompressed locking the first horizontal adjustment component 22 in place on the horizontal structural component 27. However the present invention is not limited to such embodiments, and other embodiments can be used to practice the invention.

The first horizontal adjustment component 22 and the first vertical adjustment component 26 are illustrated as a spherical shape for easy gripping. However, the present invention is not limited to such an embodiment and these components can include other shapes (e.g., oval, square, rectangle, star-shaped, circular, etc.) to practice the invention.

In one embodiment, the first vertical adjustment component 26 with the first vertical adjustment receptacle containment component 28 (FIG. 1B) is used to adjust the fastening component 20 to a desired width to grip vertical connection components of various sizes. The first vertical adjustment component 26 moves forward and backward in the vertical adjustment receptacle containment component 28 to adjust an attachment size for the first vertical adjustment component 26 to a vertical surface of the horizontal structural component 27. In another embodiment, the first vertical adjustment component 26 includes a non-adjustable first vertical adjustment receptacle containment component 28. In such an embodiment, the first vertical adjustment receptacle containment component 28 is specifically sized and shaped to include a size and shape just slightly larger (e.g., about 1/16 inches or about 1.57 millimeters (mm), larger etc.) to contain a shaft for the first vertical adjustment component 26. However, the present invention is not limited to such an embodiment and other embodiments can be used to practice the invention.

The first fastening component 20 further includes first vertical adjustment component 26 within first gripping end 20*a*1. The first vertical adjustment component 26 fastens the first gripping end 20*a*1 to a vertical edge of the horizontal structural component 27. The first vertical adjustment component 26 includes a threaded shaft 26' and/or a shaft 26' with a spring component, 26". The first vertical adjustment component 26 is rotated and/or pulled up and released in a similar manner to that just described for the first horizontal adjustment receptacle component 24 to further hold the first fastening component 20 on the horizontal structural component 27. Other embodiments for the first horizontal adjustment component 22 and first vertical adjustment component 26 include, but are not limited to, a pressure fitting locking mechanism with a quick release option, a vice clamping apparatus, a rotational tapered rotating mechanism, a swing arm clamp, a magnetic mechanism, etc. However the present invention is not limited to such embodiments, and other embodiments can be used to practice the invention.

In one embodiment, the first vertical adjust component 26 includes a threaded shaft 26' with a pointed end that acts a "screw" fastener. In such an embodiment, the threaded shaft 26' may burrow into a vertical edge horizontal structural component 27. In another embodiment the threaded shaft 26' includes a round, oval, flat and/or other shaped end. In such an embodiment, when the threaded shaft is rotated, the first vertical adjust component 26 attaches to an edge of the horizontal structural component 27 with a pressure connection. The first vertical adjustment component with a shaft 26' with a spring component, 26" also attaches to an edge horizontal connection component 66 with a pressure connection.

The first fastening component 20 includes a universal component to support connection to plural different height, width and/or depth surfaces. For example, the fastening component 20 supports, but is not limited to, connection to horizontal or vertical structural components 27 including, but not limited to, 2×4, 2×6, 2×8, 2×10, etc. sized deck rail components of an exterior deck, exterior porch railings, interior, wood and metal stud, poles, and/or other support components of circular, oval, rectangular, square, triangle, other polygon shapes, in a garage, shed, barn and/or other structure, handrails, desks, chairs, other tables, etc.

The fastening component 20, 20' 20" (FIG. 7) comprises metal (e.g., steel, stainless steel, iron, brass, aluminum, etc.), wood, rubber, plastic, composite materials and/or combinations thereof. However the present invention is not limited to such embodiments, and other materials can be used to practice or produce the invention.

Figure 6:
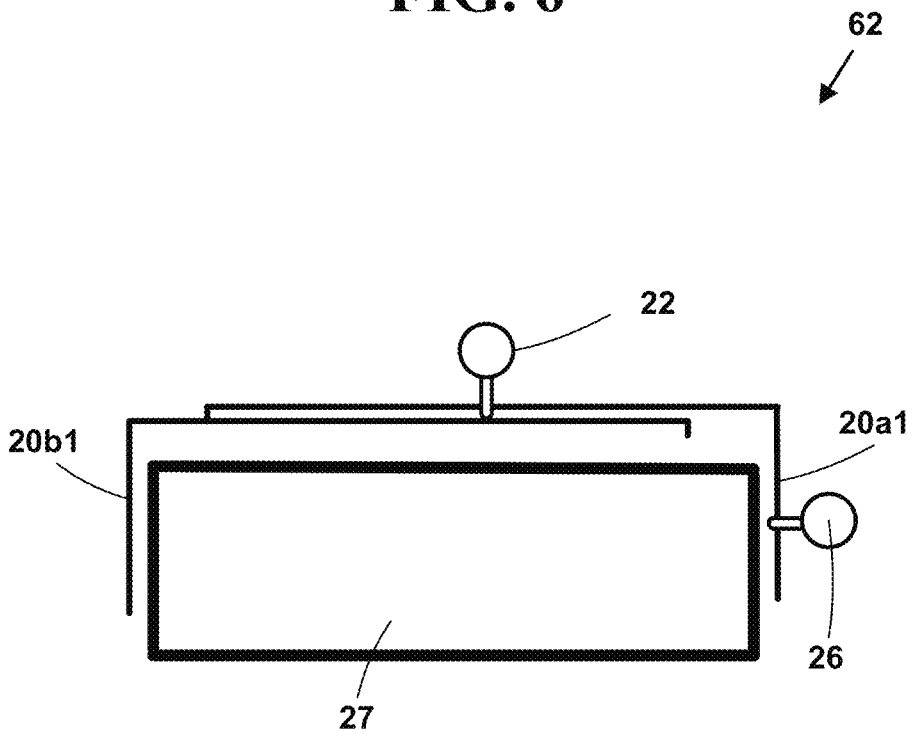
FIG. 6 is a block diagram illustrating side view the first fastening component.

FIG. 6 is a block diagram 62 illustrating a side view the first fastening component 20.

In FIG. 6, a space is illustrated between the first top portion 20*a*1 and the second bottom portion 20*b*1 and between the first fastening component 20 and the horizontal structural component 27 to further illustrate features of the first fastening component 20. However, in actual operation, a bottom surface of the first top portion 20*a*1 is in direct contact with a top surface of the second bottom portion 20*b*1 and no spacing exists there and no spacing exists between the first fastening component 20 and the horizontal structural component 27.

The other fastening components 20', 20" include identical components, including threaded shafts and spring shafts and is used in an identical manner to fastening component 20.

In one embodiment, first fastening component 20 and the second fastening component 20' are separate fastening components 20, 20' as is illustrated in FIG. 1. In another embodiment, the components of the first fastening component 20 and the second fastening component 20' are included on one single fastening component 20" as is illustrated in FIG. 7. In another embodiment, more than two fastening components 20 (e.g., three, four, five, etc.) are used to practice the invention to provide additional attachment support to the horizontal connection component 27 or vertical connection component. The number of fastening components 20 used is in part dependent a desired size, shape and weight of the frame component 14 and table top component 16 to support their operation. However the present invention is not limited to such embodiments, and other embodiments can be used to practice the invention.

The leg hinged component 34 is connected at a first end to the second edge of the frame component 14 and at a second end to an adjustable leg component 30. The second hinged component 34 allows the adjustable leg component 30 to be folded up and into underneath a bottom surface of the frame component 14 and table top component 16 when the folding table apparatus 12 is in a closed, folded configuration. However the present invention is not limited to such embodiments, and other embodiments can be used to practice the invention.

The leg hinged component 34 comprises metal (e.g., steel, stainless steel, iron, brass, aluminum, etc.), wood, rubber, plastic, composite materials and/or combinations thereof. However the present invention is not limited to such embodiments, and other materials can be used to practice or produce the invention.

FIG. 7 is a block diagram 64 illustrating a perspective view of the folding table apparatus 12 in an open, unfolded configuration.

In FIG. 7, the folding table apparatus 12 is attached to horizontal structural component 27 (e.g., deck rail, etc.)

FIG. 8 is a block diagram 66 illustrating a bottom view of the folding table apparatus 12.

FIG. 8 illustrates the leg component 36 folded up, underneath against a bottom surface of the frame component 14 and table top component 16 and is completely contained with an inner boundary of the frame component 14.

Figure 9A:
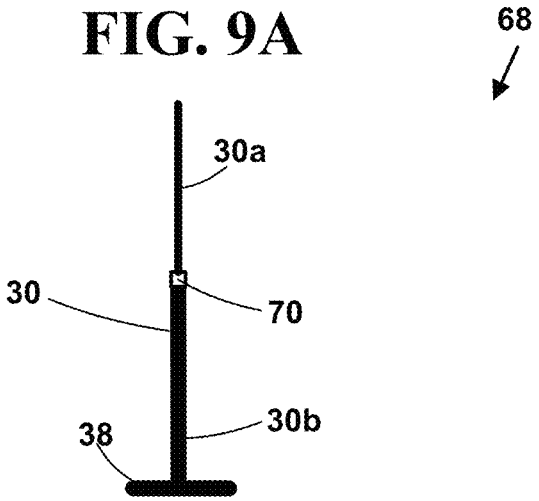
FIG. 9A is a block diagram illustrating a side view of the adjustable leg component of the folding table apparatus.

FIG. 9A is a block diagram 68 illustrating a side view of the adjustable leg component 30 of the folding table apparatus 12.

In one embodiment, the adjustable leg component 30 of the folding table apparatus 12 includes a telescoping leg component 30 that can be dynamically adjusted to plural different lengths. In such an embodiment, the leg component 30 includes plural telescoping leg components 30*a*, 30*b*, only two of which are illustrated for simplicity. In such an embodiment, smaller telescoping leg components 30*a* fit inside larger telescoping leg components 30*b*. In such an embodiment, the telescoping leg component 30 further includes a locking component 70 to securely lock the telescoping leg components 30*a*, 30*b* at a desired height. In one embodiment, the quick locking component 70 includes, but is not limited to, a quick release clamp. However the present invention is not limited to such embodiments, and other embodiments can be used to practice the invention.

Figure 9B:
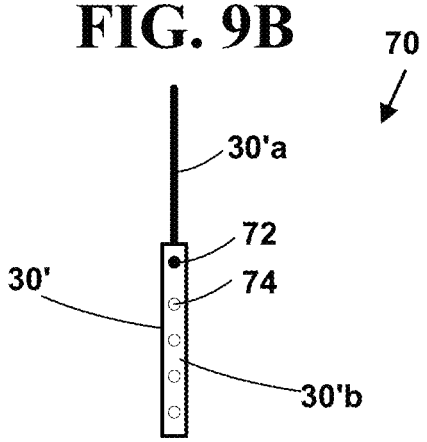
FIG. 9B is a block diagram illustrating a side view of the adjustable leg component of the folding table apparatus.

FIG. 9B is a block diagram 70 illustrating a side view of the adjustable leg component 30' of the folding table apparatus 12.

In another embodiment, the adjustable leg component 30' includes telescopic components with a "ball plunger" component. A "hail plunger" is a type of spring loaded device that's characterized by the use a ball component 72 included on a telescoping leg component 30'*a* used within a telescoping leg component 30'*b* with plural circular receptacle components 74 to engage the ball component 72 at multiple pre-determined heights. When pressure is applied, the ball 72 sinks, compressing the enclosed spring and telescoping leg component 30'*a* is moved up and down in the telescoping leg components 30'*b* to align it at a desired circular receptacle component 74. When pressure is removed, the compressive forces of the spring push the ball back up to its original position locking the two telescoping leg component 30'*a*, 30'*b* securely into positon at a desired height. However the present invention is not limited to such embodiments, and other embodiments can be used to practice the invention.

In one specific embodiment, the adjustable leg component 30 of the folding table apparatus 12 is not adjustable and includes only a single piece leg component 30 of fixed, pre-determined length (e.g. about 36 to about 48 inches, etc.). However the present invention is not limited to such embodiments, and other embodiments can be used to practice the invention.

Figure 9C:
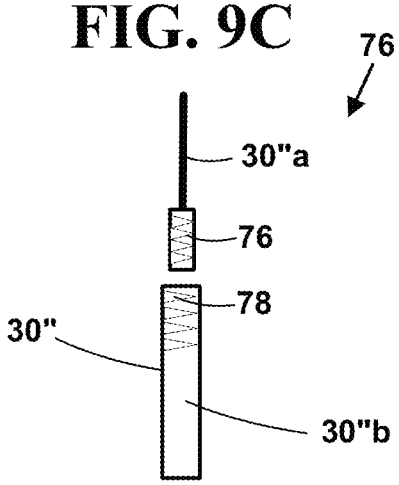
FIG. 9C is a block diagram illustrating a side view of the adjustable leg component of the folding table apparatus.

FIG. 9C is a block diagram 74 illustrating a side view of the adjustable leg component of the folding table apparatus 12.

In another embodiment, other types of adjustable leg components 30 are used into screw adjusted in which a length of the adjustable leg component 30" adjustable leg component 30"*a* with a screw mechanism 76 is moved up and down in the adjustable leg components 30"*b* with a threaded screw receptacle 78 by rotating the adjustable leg component 30"*a* in a clockwise and counterclockwise rotating motion. However the present invention is not limited to such embodiments, and other embodiments can be used to practice the invention.

The leg component 30 comprises metal (e.g., steel, stainless steel, iron, brass, aluminum, etc.), wood, rubber, plastic, composite materials and/or combinations thereof. However the present invention is not limited to such embodiments, and other materials can be used to practice or produce the invention.

In one embodiment, the leg component 30 further includes a footer component 38 for additional stability. However the present invention is not limited to such embodiments, and other materials can be used to practice the invention.

Figure 10:
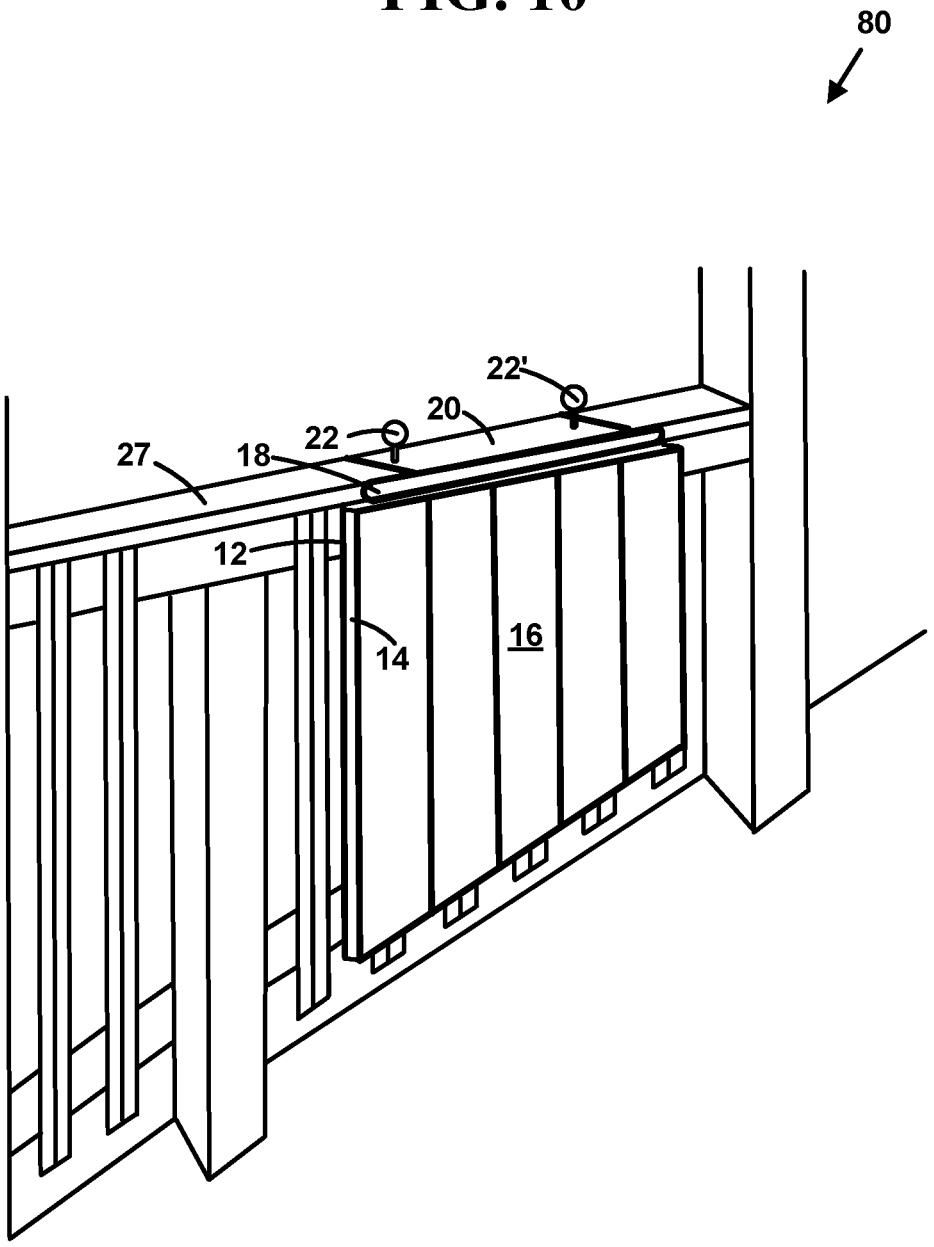
FIG. 10 is a block diagram illustrating a perspective view of the folding table apparatus in a closed, folded, configuration.

FIG. 10 is a block diagram illustrating a perspective view 80 of the folding table apparatus 12 in a closed, folded, configuration.

Figure 11:
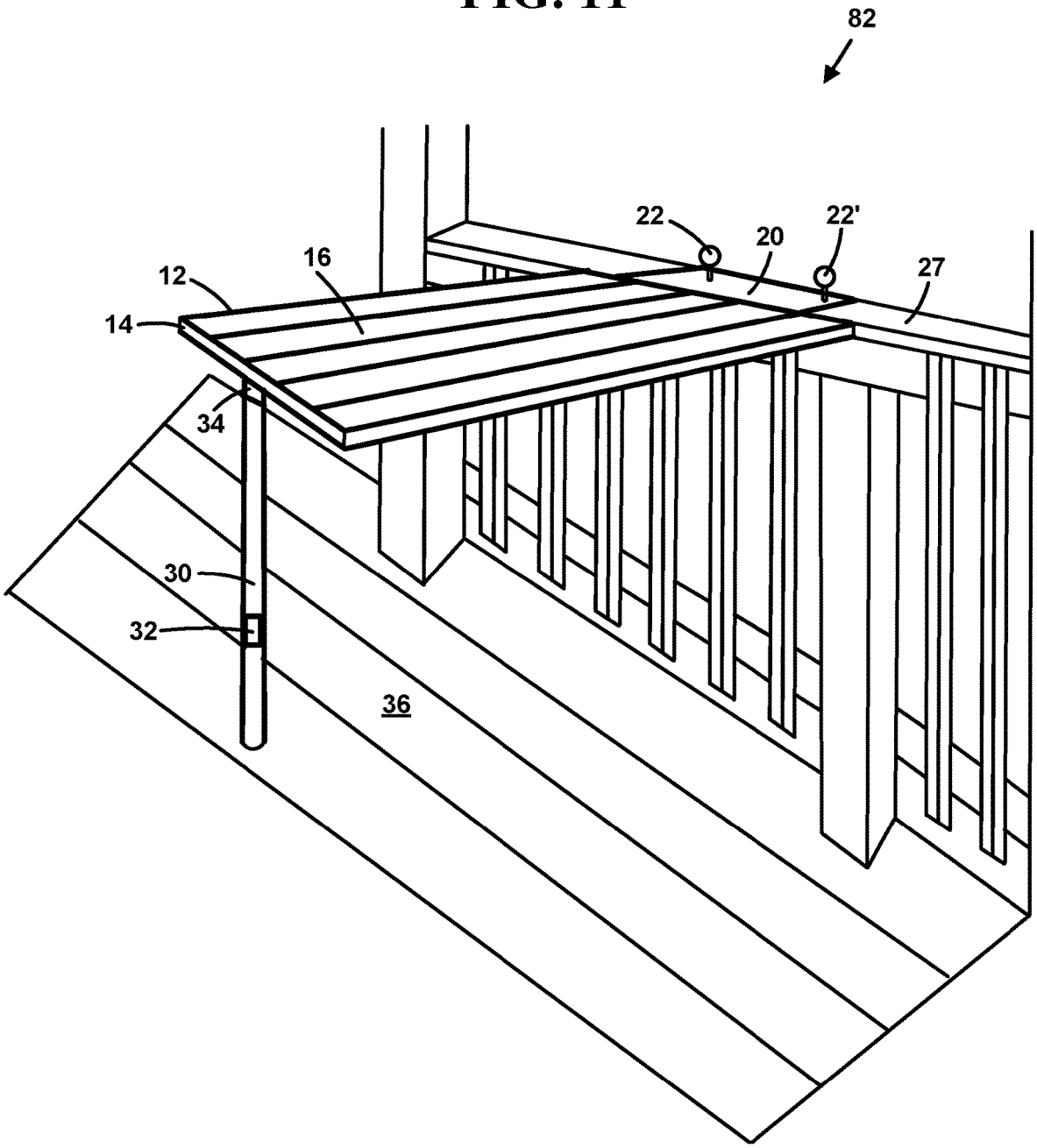
FIG. 11 is a block diagram illustrating a perspective view of the folding table apparatus in an open, unfolded configuration.

FIG. 11 is a block diagram illustrating a perspective view 82 of the folding table apparatus 12 in an open, unfolded configuration.

Figure 12:
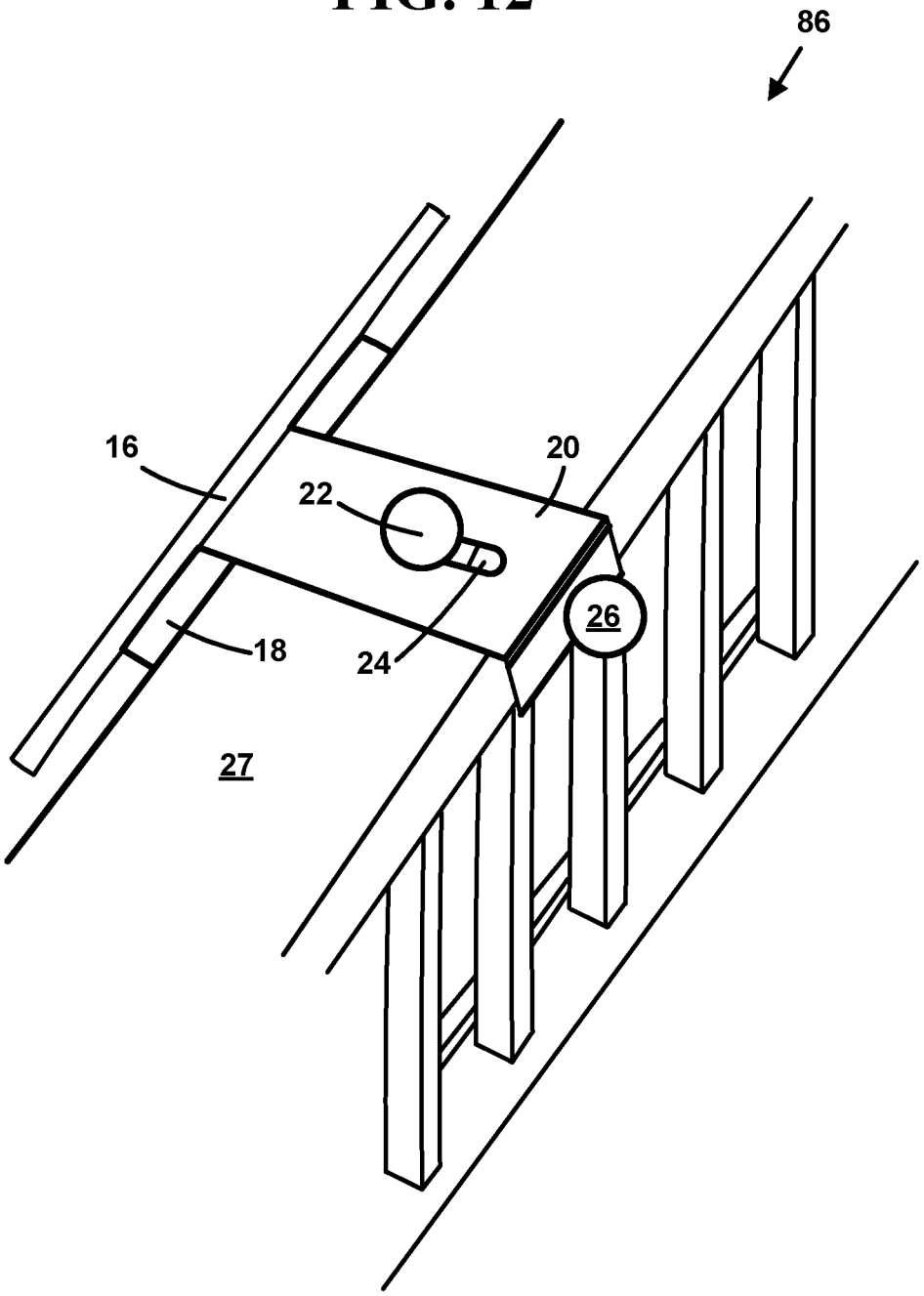
FIG. 12 is a block diagram illustrating a perspective view of an exemplary fastening component of the folding table apparatus.

FIG. 12 is a block diagram illustrating a perspective view 84 of an exemplary fastening component 20 of the folding table apparatus 12.

Components of the folding table apparatus 12 are manufactured with blow molding, wood fabrication, injection molding, steel fabrication (stainless steel, brass, aluminum, brass, steel, iron, etc.) composite material creation, extrusion molding/forming, rotational molding, pultrusion forming, thermo formed, vacuum formed, metal stamped, pullwinding, hand-made, etc. However, the present invention is not limited to these manufacturing processes and more, fewer and/or other types of manufacturing processes can be used to practice or produce the invention.

In one exemplary embodiment, the folding table apparatus 12 further includes a chair support bracket to house chairs, a racking system to house condiments, napkins, paperwork, utensils, cell phones, iPads, wire fixtures/baskets for plants, flowers plants, herbs, etc. However, the present invention is not limited to these manufacturing processes and more, fewer and/or other types of manufacturing processes can be used to practice or produce the invention.

Figure 13:
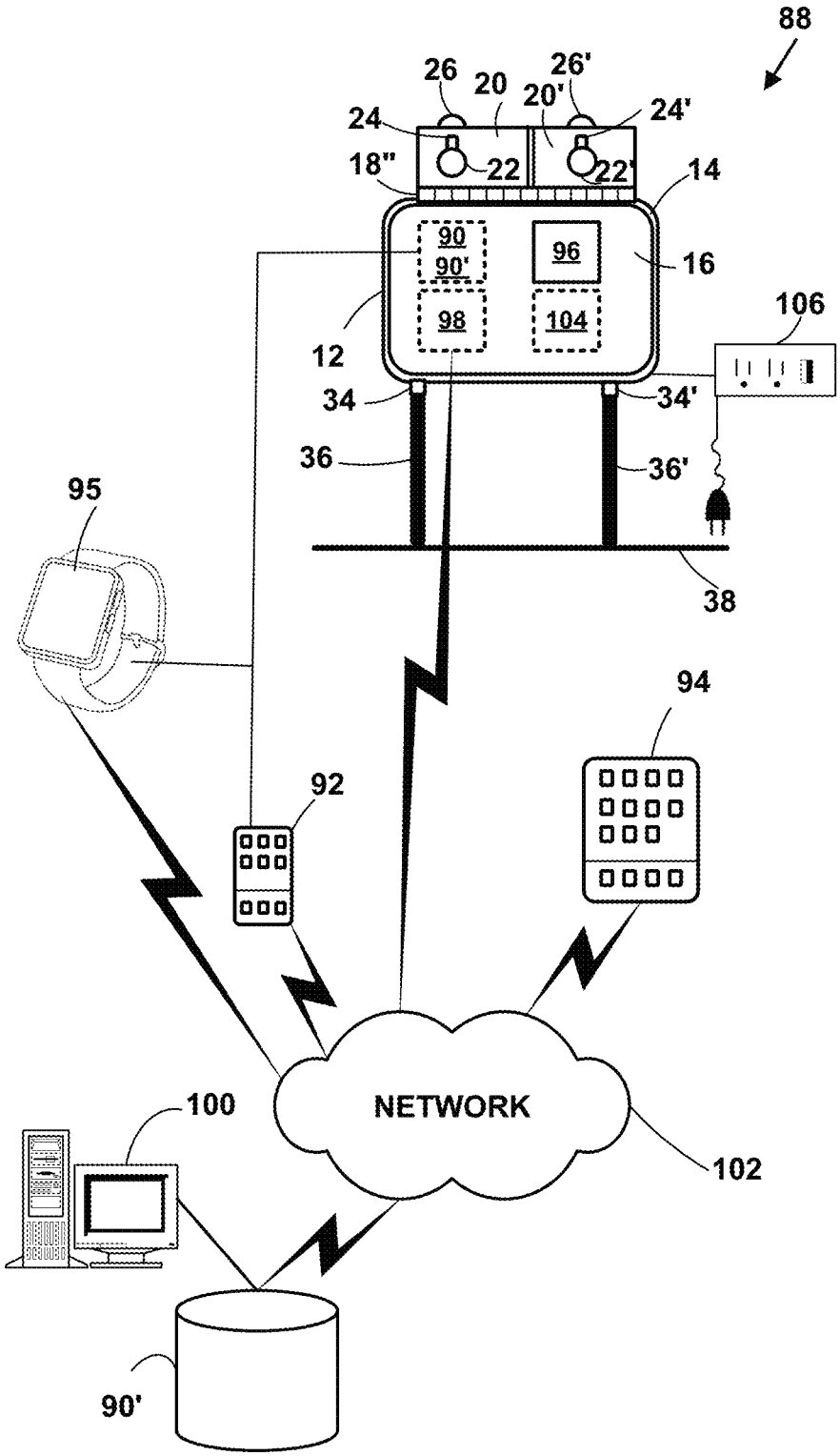
FIG. 13 is a block diagram illustrating a top view of a folding table apparatus with electronic components.

FIG. 13 is a block diagram 88 illustrating a top view of a folding table apparatus 12 with electronic components.

In one embodiment, the folding table apparatus 12 further includes electronic components including one or more of: one or more Universal Serial Bus (USB) charging ports 90 and wireless charging ports 90', for charging electronic devices such as mobile phones 92 electronic tablets 94, wearables 95, etc. (e.g., watches, fitness bracelets, glasses, rings, etc.), one or more small display screens 96 (e.g., Liquid Crystal Display (LCD), Light Emitting Diode (LED) display, Thin-Film Transistor (TFT) LCD, Quantum dot (QLED) display, Active-Matrix Organic LED, (AMOLED), etc.) with speakers to display audio, video and electronic textual information, one or more wireless communication components 98 (e.g., WiFi, cellular, 802.11x, Bluetooth, Near Field Communications (NFC), Machine-2-Machine (M2M), Infrared, etc.) for sending and receiving wireless information to/from one or more server network devices 100, with associated databases 100' via a communications network 102, one or more lighting components 104 (e.g., incandescent, compact fluorescent (CFL), halogen, and light-emitting diode (LED), etc.) to allow use of the folding table apparatus 12 at night, to add visual appeal to the folding table apparatus 12 and to be used for advertising and branding by displaying lights of desired colors by displaying lights of desired colors for the advertising and branding and/or an Alternating Current (AC) and/or Direct Current (DC) power outlet strip 106 (e.g., 110 volt, 220 volt, etc.) to provide power for additional peripherals. However, the present invention is not limited to such embodiments and more, fewer and/or other components can be used to practice the invention.

In one embodiment, the USB and wireless components 98 are attached to a bottom surface of the table top component 16 as is illustrated by the dotted lines. The display screen 96 is attached to the bottom surface of the table top component 16 and is visible through the table top component 16 via an opening provided in the table top component 16 during a manufacturing process. The one or more lighting components 104 may be attached to a top surface of the table top component 16, a bottom surface of the table top component 16 and/or one or more other surfaces of the frame component 14. However, the present invention is not limited to such embodiments and more, fewer and/or other components can be used to practice the invention.

In one embodiment, the one or more wireless communication components 98 are used to send and receive electronic information including sports scores, weather information, community event information, advertising information, corporate branding information, etc. that is displayed on the display screen 86. However, the present invention is not limited to such embodiments and other embodiments can be used to practice the invention.

In another embodiment the attachable table apparatus 12 includes other attachment components 20" that allows the attachable table apparatus 12 to be attached to a vertical surface, a flat surface, a wall surface, etc. However, the present invention is not limited to such embodiments and other embodiments can be used to practice the invention.

Figure 14:
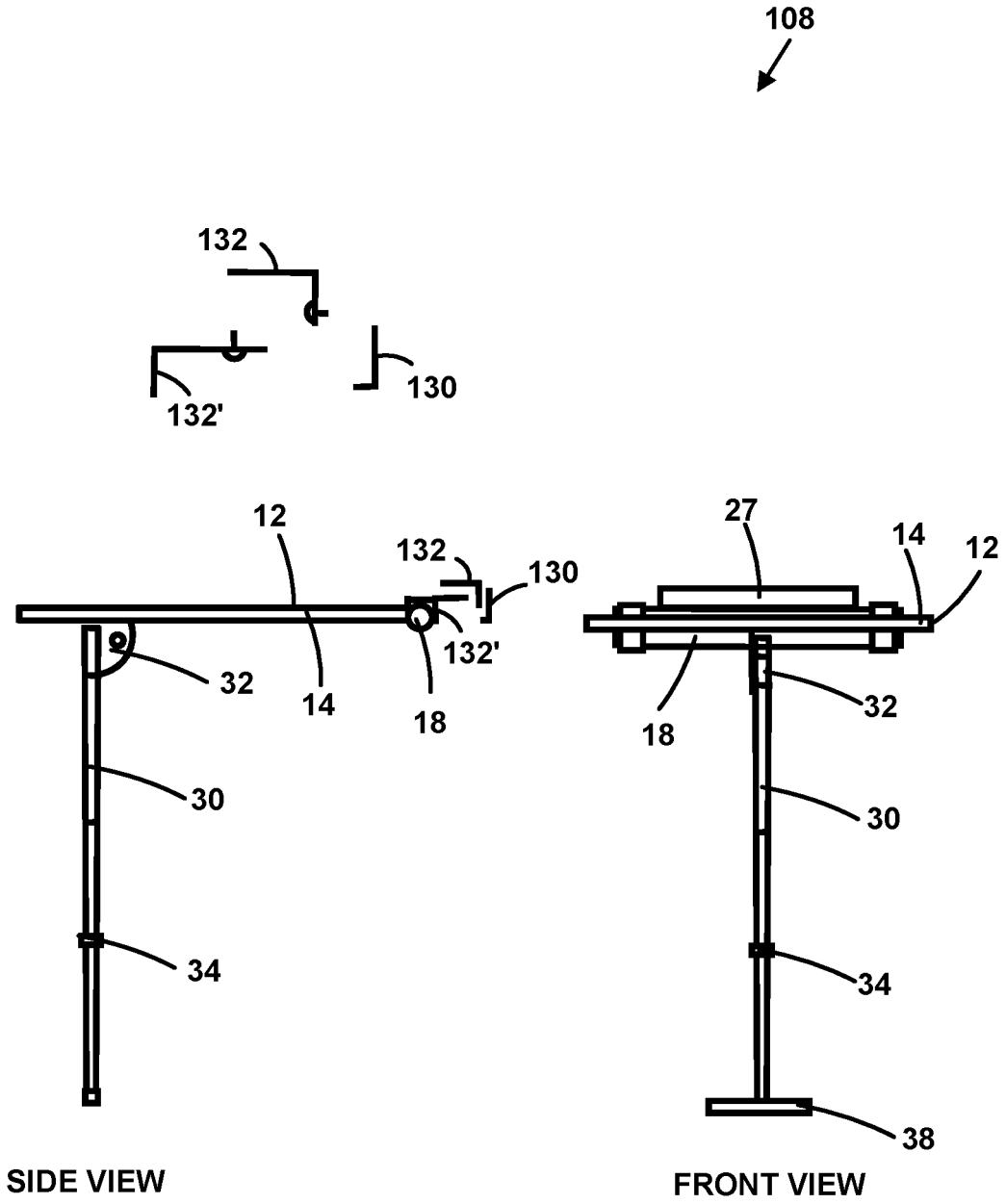
FIG. 14 is an exploded block diagram illustrating a shop diagram including a folding table apparatus.

FIG. 14 is an exploded block diagram illustrating 106 including a folding table apparatus 12.

In one embodiment, the folding table apparatus 12 further includes a work bench apparatus.

Figure 15:
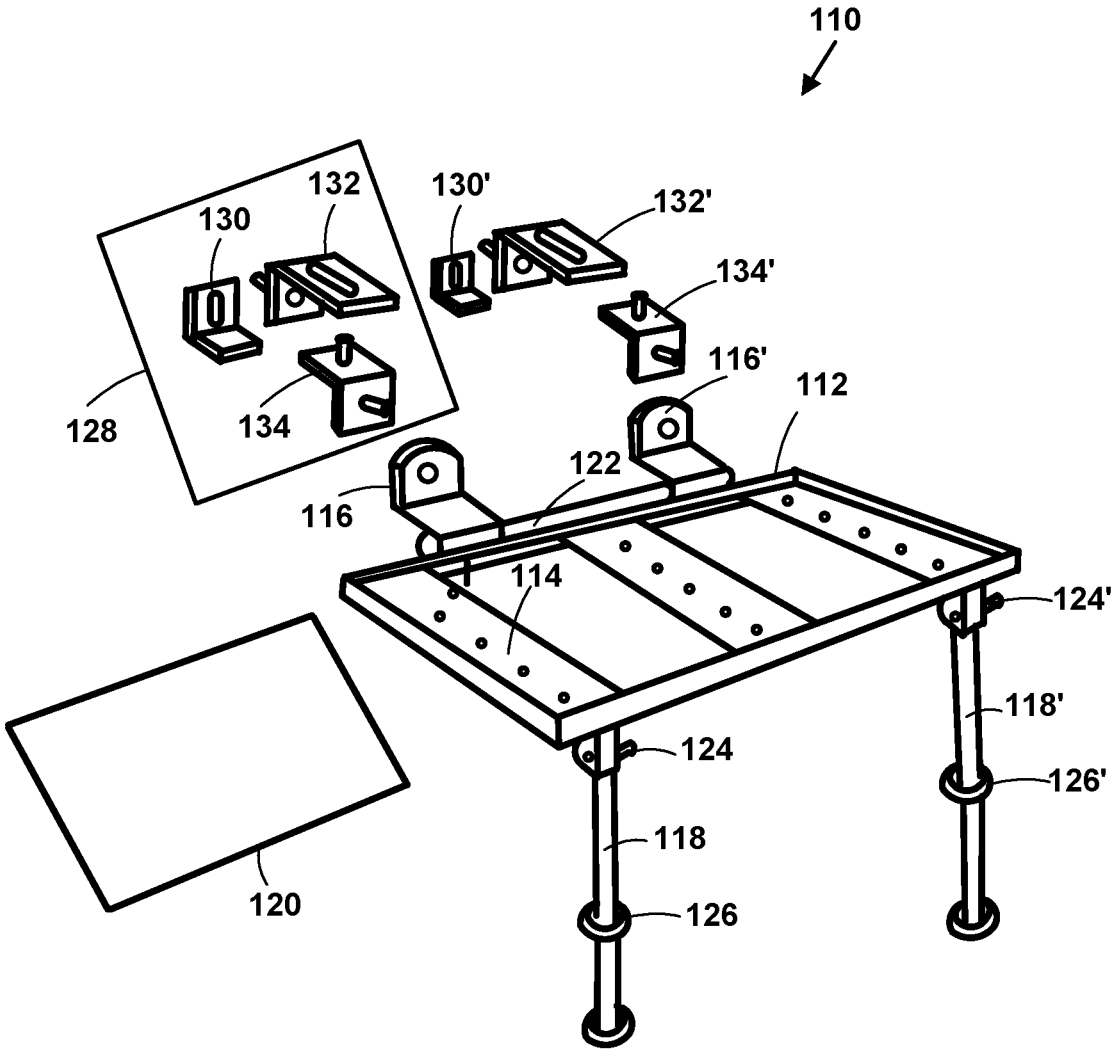
FIG. 15 is a block diagram illustrating a perspective view of an exemplary folding work bench apparatus.

FIG. 15 is a block diagram illustrating a perspective view 110 of an exemplary folding work bench table apparatus 112.

In one embodiment, the frame component 14 and table top component 16, which are a pre-determined regular size and shape (e.g., a shorter rectangle, etc.) of about 28 inches long to about 22 inches wide (about 66.04 cm to about 55.88 cm) of the folding table apparatus 12 are created in a pre-determined larger size and shape (e.g., a longer length rectangle, etc.) (e.g., about 45 inches long to about 32 inches wide, or about 114.3 cm to about 81.28 cm) to comprise a folding work bench table apparatus 112 with a work bench frame component 114 and a work bench table top component 120 including the pre-determine larger size. However the present invention is not limited to such embodiments, and other embodiments can be used to practice the invention.

The folding work bench table apparatus 112 provides a larger work surface area and is capable of being loaded with heavier items for larger and heavier projects than the folding table apparatus 12 and includes similar components as the folding table apparatus 12. The folding work bench table apparatus 112 is used in garages, workshops, factories, etc.

In FIG. 15, the folding work bench table apparatus 112 includes, but is not limited to, a work bench frame component 114, one or more attachment components 116, 116' and two or more adjustable table leg components 118, 118' (only two of which are illustrated for simplicity) a work bench table top component 120, insertable and removable from the work bench frame component 114 and one or more hinged components 122 (only one of which is illustrated for simplicity) for changing the folding work bench table apparatus 112 from a horizontal, open, unfolded configuration to a vertical, closed, folded configuration. Leg hinge components 124, 124' on two or more adjustable leg components 118, 118' that allow for folding the individual adjustable folding leg component to and from an open, un-folded configuration (FIG. 7) and a closed, folded configuration (FIG. 8). Leg adjusting components 126, 126' for allowing an individual adjustable folding leg component to be adjusted to plural different vertical lengths. However, the present invention is not limited to such embodiments and more, fewer and/or components and other embodiments can be used to practice the invention.

In one embodiment, the one or more attachment components 116, 116', include, but are not limited to, a 1-2-3 bracket system 128. A 1-2-3 bracket system 128 includes a $1^{st}$ component 130 comprising a right angle and a $1^{st}$ component receptacle on a side surface that engages a bolt and/or pin and/or screw and/or nail and/or other attachment means, protruding from a $2^{nd}$ component 132 in a $2^{nd}$ component receptacle on a top surface. The bolt and/or pin and/or screw and/or nail and/or other attachment means protruding from the $2^{nd}$ component 132 engages the first component receptacle to mount the $1^{st}$ component 130 and the $2^{nd}$ component 132 to a desired vertical or horizontal structural component. A $3^{rd}$ component 134 includes a first $3^{rd}$ component attachment means and a second $3^{rd}$ component attachment means comprising a protruding bolt and/or pin and/or screw and/or nail and/or other attachment means. The first $3^{rd}$ component attachment means engages the $2^{nd}$ component receptacle to attach the $3^{rd}$ component to the $2^{nd}$ component and thereby to the $1^{st}$ component. The second $3^{rd}$ component attachment means engages an attachment receptacle in an attachment component 116, 116' connected to the hinged component 122, which is connected to frame component 114, which mounts the folding work bench table apparatus 112 to the desired vertical or horizontal structural component (e.g., wall, studs, etc.). In this embodiment, the 1-2-3 bracket system provides a safe, secure and more permanent mounting system. However, the present invention is not limited to such embodiments and more, fewer and/or components and other embodiments with other bracketing and/or mounting system can be used to practice the invention.

In one embodiment, the one or more attachment components 116, 116', including but are not limited to the fastening components 20, 20', described herein for temporary mounting to a desired vertical or horizontal structural component.

However, the present invention is not limited to such embodiments and other embodiments can be used to practice the invention.

The work bench table top component 120 is illustrated as a single piece component in FIG. 15. However, the work bench table top component 120 can also include plural table top component pieces and materials as were described and used for attachable table apparatus 12 herein. However, the present invention is not limited to such an embodiment and more, fewer and other components and other embodiments can be used to practice the invention.

The components of the folding work bench table apparatus 112 include, but is not limited to, metal (e.g., steel, stainless steel, iron, brass, aluminum, etc.), wood, rubber, plastic, composite materials and/or combinations thereof. However the present invention is not limited to such embodiments, and other materials can be used to practice or produce the invention.

The attachable table apparatus 12 and the folding work bench table apparatus 112 provide a serving table, work station, desk, etc. for the home or work environment or at away from home events such as sporting events and commercial applications such as restaurants, bars, catered events, promotional events, etc. The attachable table apparatus 12 includes a universal mounting bracket, attachable to deck rails, wall studs, handrails, walls, etc. in a horizontal or vertical mounting orientation, on car or truck tailgates or bumpers, in boats, inside housing, garages, workshops, etc. The attachable table apparatus 12 and the folding work bench table apparatus 112 are foldable/collapsible for easy transport and space saving when not in use. The folding work bench table apparatus 112 provides a larger work space for home, work and/or other professional projects.

It should be understood that the architecture, programs, processes, methods and systems described herein are not related or limited to any particular type materials unless indicated otherwise. Various types of general purpose or specialized materials may be used with or in accordance with the teachings described herein.

In view of the wide variety of embodiments to which the principles of the present invention can be applied, it should be understood that the illustrated embodiments are exemplary only, and should not be taken as limiting the scope of the present invention. For example, the steps of the diagrams may be taken in sequences other than those described, and more or fewer elements may be used in the block diagrams.

While various elements of the preferred embodiments have been described as being implemented with a specific number of components with specific functionality and features and other implementations may alternatively be used, and vice-versa.

Therefore, all embodiments that come within the scope and spirit of the description and equivalents thereto are claimed as the invention.

I claim:

1. A folding table apparatus, comprising in combination:

a frame component enclosing a table top component;

the table top component insertable and removable from the frame component;

one or more hinged components connected at a first end to the frame component and at a second end to one or more fastening components to change the folding table apparatus from a closed, folded configuration to an open, un-folded configuration;

the one or more fastening components each comprising: a fastening component with a horizontal adjustment component with a horizontal adjustment receptacle containment component and a vertical adjustment component with a vertical receptacle containment component, connected at a first end to the one or more hinged components and at a second end to a vertical or horizontal structural component for securing the folding table apparatus to the vertical or horizontal structural component; and one or more adjustable folding leg components, including a leg adjusting component for allowing an individual adjustable folding leg component from the one or more adjustable leg components to be adjusted to a plurality of different vertical lengths, a first end of the individual adjustable folding leg component attached to the frame component with a leg hinge component for supporting the folding table apparatus in an open, un-folded configuration, the first end of the individual adjustable folding leg component including the leg hinge component for folding the individual adjustable folding leg component to and from an open, un-folded configuration and a closed, folded configuration, wherein the individual adjustable folding leg component in the closed, folded confirmation is configured with the leg adjusting component to completely fit within a boundary of the frame component and against a bottom surface of the table top component, and a second end of the individual adjustable folding leg component supporting the folding table apparatus on a horizontal surface in an open, un-folded configuration.

2. The folding table apparatus of claim 1, wherein the frame component further includes one or more vertical or horizontal structural support components or a combination thereof.

3. The folding table apparatus of claim 1, wherein the table top component includes a single component or a plurality of components of identical or different sizes.

4. The folding table apparatus of claim 3, wherein the table top component as the single component or the plurality of components includes one or more different advertising elements including a plurality of different designs and colors.

5. The folding table apparatus of claim 1, wherein the one or more hinged components include one or more of a single hinged component, a piano hinge component, a continuous hinge component, or a foldable self-locking hinge, or a combination thereof.

6. The folding table apparatus of claim 1, wherein the one or more fastening components include screw-type fastening components, spring-compression type fastening components, clamp-type fastening components in combination with a 1-2-3 bracketing system, or a combination thereof, to attach the folding table apparatus to a horizontal structural component or a vertical structural component.

7. The folding table apparatus of claim 1, wherein the one or more fastening components include a first top portion with a first gripping end and a second bottom portion that slides beneath the top portion with a second gripping end, the first gripping end and second gripping end grasping a horizontal structural component or vertical structural component to attach the folding table apparatus to the horizontal structural component or the vertical structural component.

8. The folding table apparatus of claim 1, wherein the horizontal adjustment component and the vertical adjustment component include a spherical shaped component for easy gripping.

9. The folding table apparatus of claim 1, wherein the one or more adjustable folding leg components include telescopic leg components with quick release clamp component, telescoping leg components with a ball plunger component, telescoping leg components with a screw mechanism component, or a combination thereof, allowing one or more adjustable leg components to be adjusted to the plurality of different vertical lengths.

10. The folding table apparatus of claim 1, wherein the second end of the individual adjustable folding leg component supporting the folding table apparatus further includes a horizontal surface horizontal stabilizing component.

11. The folding table apparatus of claim 1, further comprising: one or more of: one or more Universal Serial Bus (USB) charging ports or wireless charging ports, for charging electronic devices, one or more small display screens, with speakers to display audio, video and electronic textual information, one or more wireless communication components for sending and receiving wireless information to and from one or more server network devices with associated databases via a communications network, one or more lighting components, to allow use of the folding table apparatus at night and to add visual appeal to the folding table apparatus, a power outlet strip for providing alternating current (AC) power or Direct Current (DC) power for additional peripherals, or a combination thereof.

12. The folding table apparatus of claim 11, wherein the electronic devices, include mobile phones, electronic tablets, and wearable electronic devices.

13. The folding table apparatus of claim 11, wherein the one or more small display screens include: Liquid Crystal Display (LCD), Light Emitting Diode (LED) display, Thin-Film Transistor (TFT) LCD, Quantum dot (QLED) display, Active-Matrix Organic LED (AMOLED), small display screens.

14. The folding table apparatus of claim 11, wherein the one or more wireless communication components include one or more of: a WiFi, cellular, 802.11x, Bluetooth, Near Field Communications (NFC), Machine-2-Machine (M2M) or Infrared, wireless communication interface, or a combination thereof.

15. The folding table apparatus of claim 11, wherein the one or more lighting components include one or more of: incandescent, Compact FLuorescent (CFL), halogen or Light, Emitting Diode (LED) lighting components or a combination thereof.

16. The folding table apparatus of claim 11, wherein the one or more lighting components allow use of the folding table apparatus at night, add visual appeal to the folding table apparatus and allow the folding table apparatus to be used for advertising and branding by displaying lights of desired colors for the advertising and branding.

17. The folding table apparatus of claim 1, wherein the individual components of the folding table apparatus include: metal, wood, rubber, plastic, composite materials, or combinations thereof.

18. The folding table apparatus of claim 1, wherein the individual components of the folding table apparatus are manufactured with a blow molding, wood fabrication, injection molding, steel fabrication, composite material creation, extrusion molding, extrusion forming, rotational molding, pultrusion forming, thermo formed vacuum formed, metal stamped, pullwinding, or combination thereof, manufacturing process.

19. The folding table apparatus of claim 1, wherein frame component and table top component are created in a predetermined larger size to comprise a folding work bench table apparatus with a work bench table top component.

20. A folding work bench table apparatus, comprising in combination:

a work bench frame component comprising a pre-determined work bench table size and shape, enclosing a work bench table top component within the work bench frame component;

the work bench table top component insertable and removable from the frame component comprising the pre-determined work bench table size and shape;

one or more hinged components connected at a first end to the frame component and at a second end to one or more fastening components to change the folding work bench table apparatus from a closed, folded configuration to an open, un-folded configuration;

the one or more fastening components for securing the folding work bench table apparatus to a vertical or horizontal structural component; and a plurality of adjustable folding leg components, including a leg adjusting component for allowing an individual adjustable folding leg component from the plurality of adjustable leg components to be adjusted to a plurality of different vertical lengths, a first end of the individual adjustable folding leg component attached to the work bench frame component with a leg hinge component for supporting the folding work bench table apparatus in an open, un-folded configuration, the first end of the individual adjustable folding leg component including the leg hinge component for folding the individual adjustable folding leg component to and from an open, un-folded configuration and a closed, folded configuration, wherein the individual adjustable folding leg component in the closed, folded confirmation is configured with the leg adjusting component to completely fit within a boundary of the work bench table frame component and against a bottom surface of the work bench table top component, and a second end of the individual adjustable folding leg component supporting the folding work bench table apparatus on a horizontal surface in an open, un-folded configuration.

* * * * *